United States Patent [19]

Wilkinson, Jr. et al.

[11] 4,090,643

[45] May 23, 1978

[54] HOT MELT APPLICATOR

[75] Inventors: Everett R. Wilkinson, Jr., Rockport; Henry E. Cooper, IV, North Andover, both of Mass.

[73] Assignee: The Terrell Corporation, Wilmington, Mass.

[21] Appl. No.: 724,178

[22] Filed: Sep. 17, 1976

[51] Int. Cl.[2] ..... B67D 5/62

[52] U.S. Cl. ..... 222/146 HE; 219/421; 226/165; 226/167

[58] Field of Search ..... 228/52, 53; 226/165, 226/158, 127, 167; 222/146 R, 146 H, 146 HE; 219/421, 230; 425/133.1

[56] References Cited

U.S. PATENT DOCUMENTS

| | | | |
|---|---|---|---|
| 2,111,308 | 3/1938 | Baxendale | 226/167 X |
| 2,821,947 | 2/1958 | Von Knauf | 226/167 X |
| 2,995,159 | 8/1961 | Berggren | 222/146 HE X |
| 3,314,574 | 4/1967 | Longval et al. | 222/146 HE |
| 3,774,817 | 11/1973 | Whittaker | 222/146 HE X |
| 3,964,644 | 6/1976 | Wallace | 222/146 HE |

*Primary Examiner*—Allen N. Knowles
*Assistant Examiner*—David A. Scherbel
*Attorney, Agent, or Firm*—Robert E. Meyer

[57] ABSTRACT

A hot melt applicator of the type in which a preformed rod of thermoplastic composition is pressed against a heated body which transforms the composition in contact therewith into a molten state and in which pressure applied upon the pre-formed rod forces the molten hot melt composition through a nozzle or other aperture. The invention relates to improvements in the melting head, and in the rod advancing and feed mechanism.

11 Claims, 11 Drawing Figures

GND.

HOT MELT APPLICATOR

BRIEF SUMMARY

Over the past 25 years or so a considerable art has developed concerned with melting thermoplastic resinous compositions and dispensing the molten resinous compositions as desired. In one segment of this art the thermoplastic composition is supplied in the form of a pre-formed rod or the like. The rod is pressed into contact with a surface heated sufficiently to convert the composition to the molten form and the molten composition is forced through an aperture such as a nozzle or the like by pressure applied to the unmelted rod. This invention has to do with this segment of the art.

While most usually the thermoplastic resinous composition is a so-called hot melt adhesive, the function of converting a rod of thermoplastic resinous composition to molten form and forcing the molten resinous composition through an aperture by means of pressure applied to the solid rod is largely independent of the formulation of thermoplastic resinous composition and of the purpose for which it is intended to be used. Also, while most frequently the devices of the type contemplated are made in the form of hand-held applicator guns, the size and outside shape of the assembled device and whether or not it is portable, is of no real importance to the functionality of the means used to achieve the desired results.

Devices of the type involved appear to be well classified in the Patent and Trademark Office patent classification system, and all of the patents known to applicants which relate to the hot melt applicator of the present invention appear to be classified either as references or cross-references in Class 222-146R, 222-146H and 222-146HE.

The typical thermoplastic resin composition of the type contemplated to be used in applicator devices of the type described is characterized by the fact that it has a relatively broad softening range, is very viscous at temperatures where it first becomes mobile, has a relatively low level of heat-conductivity and increases volumetrically as it is heated. The rods are normally formed from molten composition either by casting or extruding the molten material. No matter how carefully the rods are made, the dimensions of the cooled rod will be less than that of the casting mold or extrusion die and the deviation in dimension will vary somewhat from composition to composition. Also even if perfectly cylindrical as cast or extruded, the rods will tend to become somewhat out of round as they cool.

A major problem with most applicators of the type contemplated is that when pressure is applied to the solid rod to force the molten composition through the aperture and if the rod is undersized or out of round, a certain portion of the molten composition will be forced back alongside the solid rod away from the source of heat and will resolidify between the rod and the associated supporting surface, thereby increasing the resistance of the rod to further movement.

It is an object of the present invention to provide a hot melt applicator that will operate effectively with pre-formed rods of thermoplastic composition having a wide range in diameter and ovality. It is a further object of this invention to provide a device which is readily fed with additional rods of thermoplastic composition as the previous rods are used up and is easily disassembled and maintained. These and other objects will become apparent from the detailed description.

DETAILED DESCRIPTION

Figures 1, 2, 10, 11:
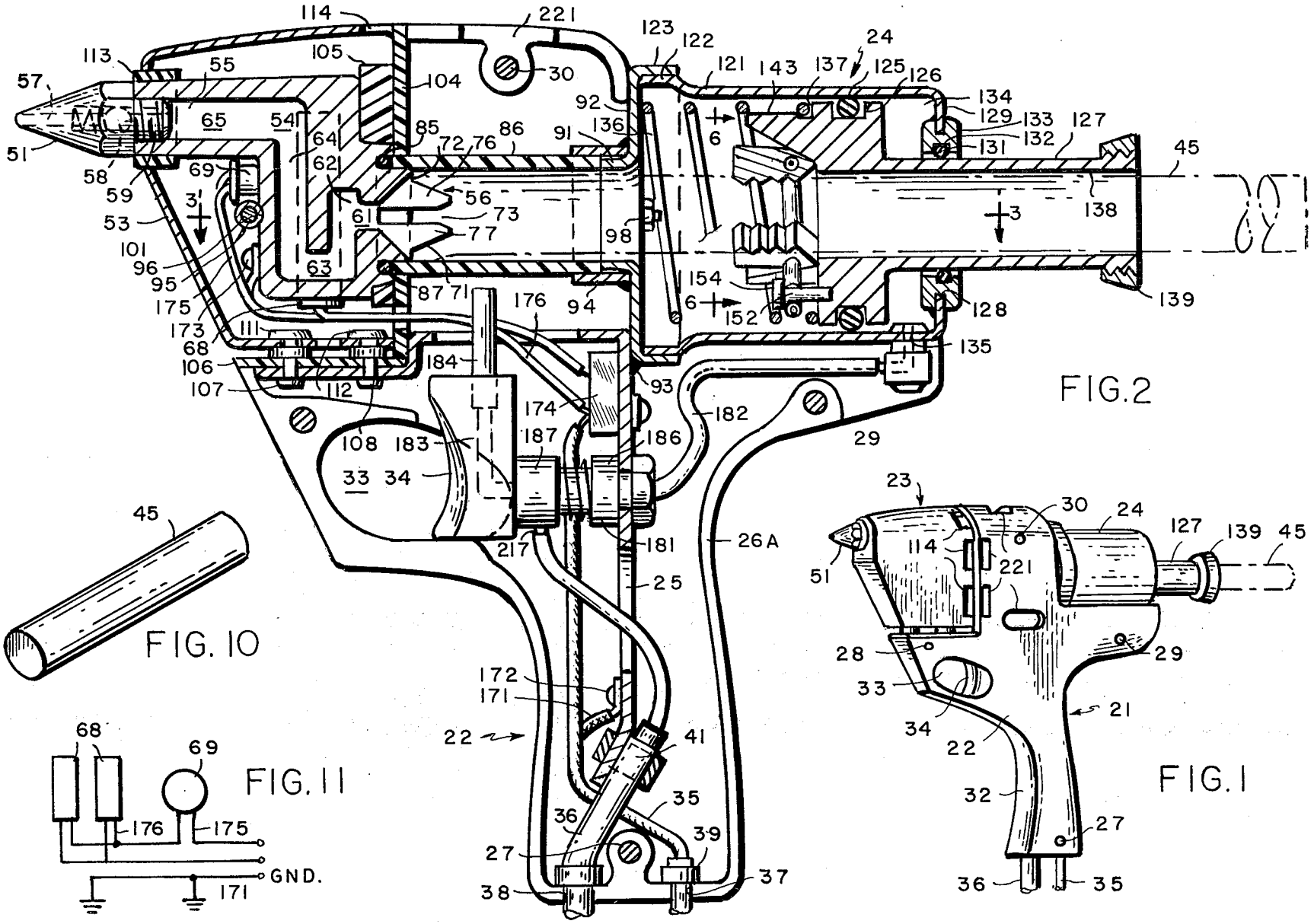
FIG. 1 is an overall view in elevation of the hot melt applicator gun of the present invention.
FIG. 2 is a cross-section of FIG. 1.
FIG. 10 is an isometric view of a rod of thermoplastic composition.
FIG. 11 is a wiring diagram.
Figure 6:
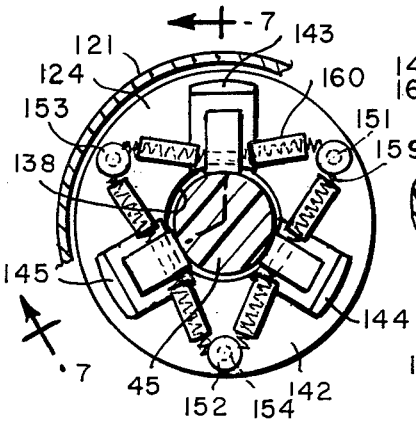
FIG. 6 is a plan view partially in section along line 6—6 of FIG. 2.

While the hot melt applicator of the present invention can assume a number of different overall shapes depending on the use for which it is intended, a particularly useful embodiment is the hand-held applicator gun indicated generally at 21 which comprises generally a body portion 22, a heater/nozzle assembly 23 and a feed mechanism assembly 24.

Body portion 22 comprises a main frame member 25 shaped generally in the form of an inverted L formed from a suitable metal and an outer shell 26 formed from a suitable high-impact plastic in two matching halves 26A and 26B joined together by removable fastener elements as indicated at 27, 28, 29 and 31. The lower portion of body portion 22 is formed in the shape of a hand grip 32 and an aperture 33 in which is located trigger 34 is provided at a convenient location in body portion 22 to receive a forefinger. Electric conduit 35 and compressed air tube 36 pass through the lower edge of hand grip 32 to the inside of body shell 26 through suitable apertures 37 and 38 provided therein. A washer 39 is provided around electric conduit 35 at a position to rest on the inner side of body shell 26 to relieve conduit 35 from external forces and compressed air tube 36 is clamped at 41 to the lower downwardly depending portion of main frame member 25 for the same purpose.

Heater/nozzle assembly 23 comprises a nozzle 51, a heater block 52 and a cover element 53. Heater block 52 which is formed from a metal having a high level of heat capacity and heat conductivity is provided with an internal passage 54 which terminates at one end in a portion 55 to receive nozzle 51 and at the other end in melt face or head 56. In the preferred embodiment internal passage 54 is of a modified U-shape having three horizontal portions 61, 63 and 65 and two vertical portions 62 and 64 with four right-angle bends therebetween both to increase the time of contact between the molten hot melt composition passing therethrough with heater block 52 and to increase the degree of mixing within the molten composition in passing around the right-angle bends to insure that the rather viscous molten hot melt composition will come to as uniform an elevated temperature as possible.

Nozzle 51 is provided with an internal passage 57 for the passage of molten hot melt composition therethrough. Passage 57 may be provided with a conventional spring and ball check valve indicated at 58 to prevent the drip of molten hot melt composition therefrom when the pressure on the molten composition is relieved. Nozzle 51 is provided with a threaded shank 59 to mount into and cooperate with tapped threads in nozzle-receiving portion 55 of heater block 52.

Heater block 52 is provided with two elongated heater receiving cavities 66 and 67 which extend vertically from the bottom surface of block 52 on either side of internal passage 54 with the axes thereof generally parallel to and equidistant from the axis of vertical portions 62 and 64 of internal passage 54. An elecrtric heater element indicated at 68 is mounted in each of cavities 66 and 67. A temperature control thermostat 69 is mounted on the outer wall of heater block 52 adjacent vertical portion 64 of internal passage 54 equidistant from the two heater elements 68.

Figure 4:
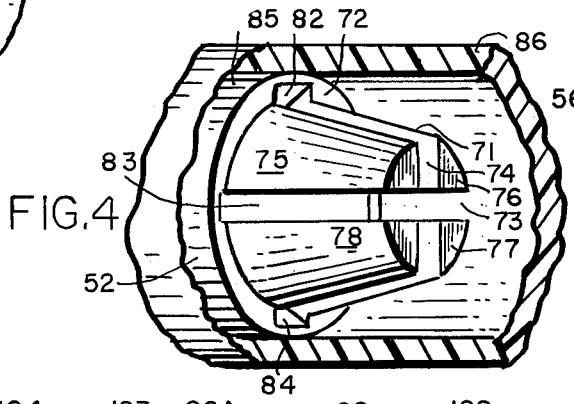
FIG. 4 is an isometric view partially in section showing details of the melt head.
Figure 5:
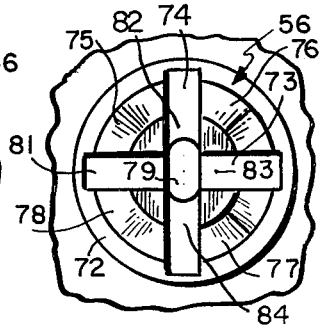
FIG. 5 is a plan view corresponding to FIG. 4.
Figure 3:
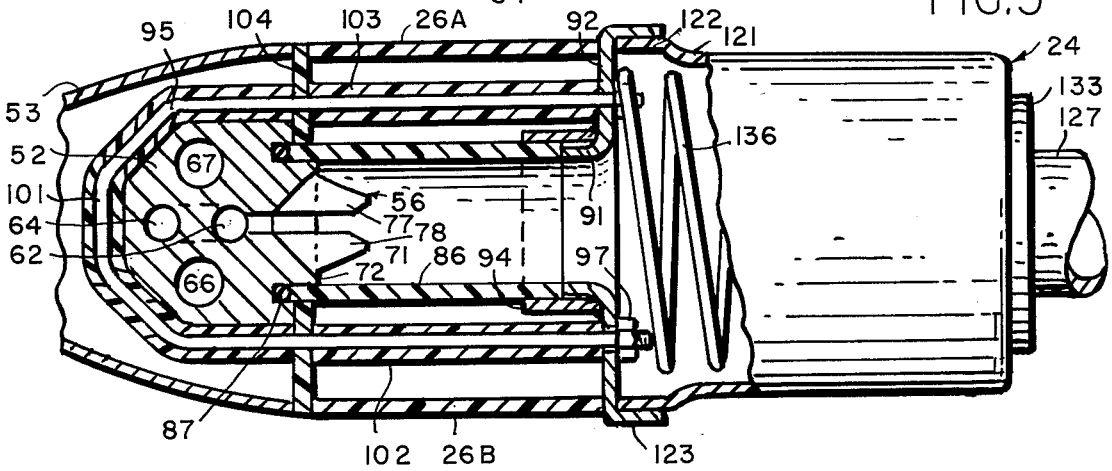
FIG. 3 is a section along line 3—3 of FIG. 2.

Melt face or head 56 (see FIGS. 4 and 5) is in the form of truncated cone 71 upstanding from face 72 of heater block 52. In a preferred embodiment the height of cone 71 is slightly more than one-half of the diameter of the cone at its base (0.35 in. high when the base diameter is 0.625 in.) and the included angle between the side wall and the axis of cone 71 is about 20°. The base diameter of cone 71 is slightly less than the diameter of the rod 45 of hot melt composition to be used. Cone 71 is bisected by each of two slots 73 and 74, each said slot being arranged parallel to the axis of cone 71 and being centered on a radius perpendicular to the radius on which the other slot is centered forming four upstanding truncated conical segments 75, 76, 77, 78. In a typical embodiment slots 73 and 74 are of a substantial width approximately equal to 20 percent of the base diameter of cone 71.

Slots 73 and 74 are extended below the plane of face 72 into heater block 52 with the opposing back walls of each slot directed toward the other back wall at an angle which in the preferred embodiment is about 45° forming drain passages 81, 82, 83 and 84. Drain passages 81, 82, 83, and 84 terminate in throat 79 which throat forms the entrance to internal passage 54. At the intersection with face 72 drain passages 81, 82, 83 and 84 extend beyond the base of cone 71. A cylindrical channel 85 is formed in heater block 52 concentric with the axis of cone 71 and has an inner diameter slightly beyond the intersection of drain passages 81, 82, 83 and 84 with face 72. A rigid tube 86 made of a heat-resistant material of relatively low conductivity is mounted in channel 85 on gasket 87. The inner diameter of tube 86 is slightly larger than the maximum outside diameter of the rod 45 of hot melt composition intended to be used in applicator 21.

Tube 86 extends to flange 91 of mounting plate 92. Mounting plate 92 is attached to main frame member 25 as by being welded thereto as indicated at 93. A collar 94 is provided around flange 91 to receive tube 86. A U-clamp 95 is provided which passes around groove 96 formed in heater block 52 in the face thereof adjacent nozzle 51 and passes through two apertures in mounting plate 92 where clamp 95 is held in place by nuts 97 and 98. U-clamp 95 is covered by thermal insulation as indicated at 101, 102 and 103 to reduce the transfer of heat from heater block 52 to mounting plate 92. A thermal barrier 104 is provided surrounding tube 86 between body portion 22 and heater/nozzle assembly 23 of gun 21 and insulation 105 is provided between heater block 52 and thermal barrier 104. A second thermal barrier 106 is provided on the top surface of the forwardly extending portion of main frame member 25. Thermal barriers 104 and 106 together effectively isolate heater/-nozzle assembly 23 from the remainder of gun 21 to minimize the transfer of heat from heater/nozzle assembly 23.

Cover element 53 formed of a high impact heat-resistant plastic material is mounted on the forward extension of main frame 25 by means of removable fasteners 107 and 108 which pass through apertures formed in frame 25, thermal barrier 106 and cover element 53. Insulating washers 111 and 112 are provided on fasteners 107 and 108 to separate cover element 53 from thermal barrier 106. Insulated washer 113 is provided between heater block 52 and cover element 53 where heater block 52 extends through cover element 53 adjacent nozzle 51. A plurality of air vents 114 are provided in cover element 53 adjacent thermal barrier 104.

Feed mechanism assembly 24 is mounted in cylindrical member 121 which terminates at one end in a circular collar 122. Collar 122 fits into a circular flange 123 provided around the outer periphery of mounting plate 92 and facing in the opposite direction from collar 94. Cylindrical member 121 is releasably connected to flange 123, preferably by a quick-release element such as a bayonet mount or the like.

Piston 124 is located within cup-like cylindrical element 121 in sliding relation thereto. An O-ring 125 is mounted in groove 126 provided around the periphery of piston 124 to provide an air-tight sliding seal between piston 124 and cylinder 121. Piston 124 is provided with a tubular extension 127 which passes through aperture 128 provided in rear wall 129 of cylinder 121. Aperture 128 is provided with an O-ring 131 mounted in groove 132 formed in the inner periphery of retainer ring 133. Retaining ring 133 is mounted in rear wall 129 of cup-like cylindrical member 121. O-ring 131 contacts the outer surface of tubular extension 127 to form an air-tight sliding seal therewith. The space contained between O-rings 125 and 131 within cylinder 121 forms an air chamber 134. An air inlet 135 into air chamber 134 is provided through the side wal of cylindrical element 121. A coil spring 136 is provided between the face of mounting plate 92 and shoulder 137 provided on the outer periphery of piston 124 to normally urge piston 124 toward the rear. Piston 124 and tubular extension 127 are provided with an aperture 138 sized to receive a rod of hot melt composition extending therethrough. Tubular extension 127 is of sufficient length to accommodate the full stroke of piston 124 and is provided with an external collar 139 at the end thereof.

The face 142 of piston 124 is provided with a plurality of at least two and preferably three or more outstanding external ramp elements 143, 144 and 145 equally spaced around aperture 138. Each ramp element 143, 144 and 145 is provided with a planar slope indicated at 146 extending outwardly from a shoulder indicated at 147 on face 142 surrounding aperture 148 at an angle to the axis of aperture 138. In a preferred embodiment the angle between the plane of slope 146 and the axis of aperture 138 is about 30°. Equidistant between each said ramp element 143, 144 and 145 and at an equal radius from the axis of aperture 138 is mounted a spring-retaining post 151, 152 and 153, each having a head as indicated at 154. In the preferred embodiment as shown in FIGS. 2, 3 6, 7 and 8, each ramp element 143, 144 and 145 is provided with a sliding rocker element 155, 156 and 157. Each said sliding wedge element is provided with an aperture as indicated at 158 and a spring 159 passes through each said aperture 158 and around retaining posts 151, 152 and 153. Tubular spacing elements 160 may be provided on spring 159 on either side of each rocker element 155, 156 and 157.

Figure 7:
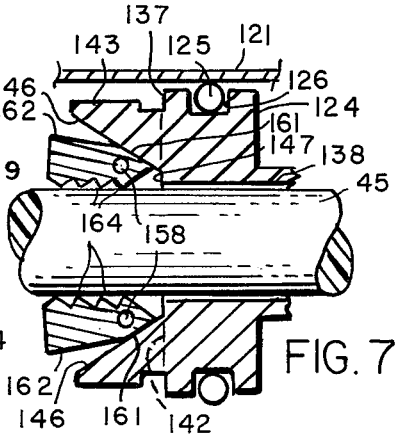
FIG. 7 is an elevation partially in section along line 7—7 of FIG. 6.
Figure 8:
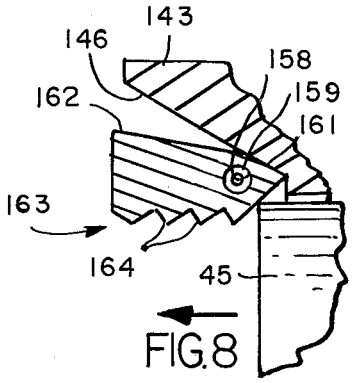
FIG. 8 is a detail partially in section of a portion of FIG. 7.
Figure 9:
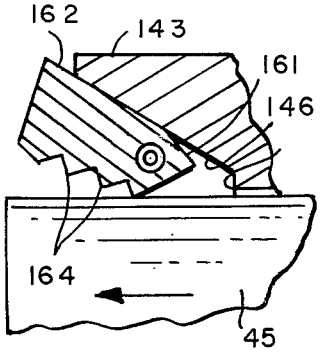
FIG. 9 is a plan view of the gripping element shown in FIGS. 6, 7 and 8.

As shown in detail in FIGS. 7, 8 and 9, the rear face of each said rocker element 155, 156 and 157 is provided with a minor planar surface 161 adjacent shoulder 147, and a major planar surface 162 remote from shoulder 147 forming a pivot point therebetween. The plane of surface 161 is about 20° offset from the plane of surface 162 although the precise angle does not appear to be critical. The forward face 163 of rocker element 155, 156 and 157 is arranged to be substantially parallel to the axis of aperture 138 when minor planar surface 161 is in contact with planar slope 146 of ramp elements 143, 144 and 145. Face 163 is provided with a plurality of serrations 164. The peak of the serration closest to shoulder 147 acts as a trip point and preferably the trip point, the center of aperture 158, and the pivot are in line and about 90° to the axis of aperture 138 when surface 161 is in contact with planar slope 146. The geometry is such that this is the normal position with each rocker element substantially in contact with shoulder 147 when there is no rod 45 present. The dimensions are such that the smallest rod 45 of thermoplastic composition intended to be used will contact each rocker element 155, 156 or 157 on the slope between the trip point and shoulder 147 as shown in FIG. 8.

As rod 45 is advanced into piston 124 as shown in FIG. 9 rocker elements 155, 156 and 157 are forced up slope 146 away from shoulder 147 until the trip point of each clears the side of rod 45 and at the same time each rocker element pivots around the pivot point forcing major planar surface 162 into contact with slope 146. It will be appreciated that each rocker element moves independently of the others thus allowing for the condition where rod 45 is not perfectly cylindrical. This condition where major planar surface 162 is in contact with slope 146 also applies when piston 124 is being returned by spring 136.

As soon as piston 124 moves toward the left as when air is introduced into chamber 134, rocker elements 155, 156 and 157 pivot around the pivot point forcing serrations 164 into contact with the face of rod 45, as shown in FIG. 7. In this position any resistance to the movement of piston 124 will force rocker elements 155, 156 and 157 down slope 146 toward shoulder 147 increasing the grip of serrations 164 against rod 45. This pivoting action of sliding rocker elements 155, 156 and 157 provides a very quick gripping and releasing action with respect to rod 45.

While this disclosure is to three ramp elements 143, 144 and 145 and three sliding rocker elements 155, 156 and 157, there is no reason why as few as two or as many as four or more such elements cannot be used, although there appears to be no advantage in so doing. The basic requirement is that the ramp and sliding rocker pairs be symmetrically arranged around the periphery of aperture 138. The width of each sliding rocker element is not critical as long as the element is dimensionally stable. In the preferred embodiment, the sliding rocker element is about ¼ in. wide where rod 45 has a normal diameter of 0.715 in. Similarly, while as disclosed, the exposed faces 163 of wedges 155, 156, and 157 are flat in the transverse direction, there is no reason why these faces could not be curved one way or the other provided the line of contact with the side of rod 45 remains substantially parallel to the axis of aperture 138.

The electric supply conduit 35 is preferably provided with a separate ground wire as indicated in the wiring diagram, FIG. 11. Ground wire 171 is attached both to frame 25 as indicated at 172 and to heater block 52 as indicated at 173. The two heater elements 68 are connected in parallel to each other and the two as a pair are connected in series to thermostat 69. A junction box 174 is provided on frame 25. The lead from junction box 174 to thermostat 69 is indicated at 175 and the leads from junction box 174 to heater elements 68 are indicated at 176.

In the compressed air supply compressed air from any conventional source is led through compressed air duct 36 to valve 181 on which trigger 34 is mounted. Valve 181 is mounted on main frame 25. A flexible conduit 182 connects air valve 181 to air inlet 135. An air passage 183 may be provided with trigger 34 leading to tube 184 which extends through slot 185 provided therefor in main frame member 25. The end of tube 184 may be directed toward the bottom of tube 86. Air valve 181 comprises two elements, fixed element 186 and sliding element 187. Fixed element 186 is affixed to main frame member 25.

Sliding element 187 is a collar which slides over cylindrical portion of fixed element 186. The end of collar 187 remote from fixed element 186 is connected with trigger 34. Collar 187 is normally urged away from fixed element 186 by a coil spring.

When trigger 34 is depressed air is introduced from air duct 36 through nipple 217 of sliding element 187 of air valve 181, through fixed element 186 and flexible conduit 182 to air chamber 134 behind piston 124, thereby advancing piston 124. When trigger 34 is released the supply of compressed air is shut off and the air in air chamber 134 is exhausted through conduit 182, valve 181, air passage 183 and tube 184.

To operate the hot melt applicator of the present invention one merely attaches electric conduit 35 to a suitable power source and compressed air tube 36 to a supply of compressed air and inserts a rod 45 of hot melt composition through tubular extension 127 of feed mechanism 24 into contact with melt head 56. Thereafter by depressing trigger 34 rod 45 is advanced by feed mechanism 24 applying pressure to the pool of molten composition in melt head 56 and forcing the molten composition through passage 54 of heater block 52 and out through passage 57 of nozzle 51. As soon as one rod 45 is substantially used up a second rod 45 can be inserted. One of the advantages of the sliding rocker elements of the preferred embodiment for the feed mechanism is that the back surface of the elements will press against the rear end of a partially consumed rod, thus clearing the jaws for the insertion of a second rod.

A major advantage of the conical melting head of the present invention wherein passages are provided through the cone to an axially oriented central port, is that the arrangement very effectively inhibits any force-back of molten material as advancing pressure is applied to the rod. Thermoplastic compositions of the type contemplated have a fairly broad melting range and the composition softens and becomes pliable at temperatures below the temperature at which it becomes mobile. By centering the pool of molten composition within a conical melting head and the melting head is at all times surrounded by a reverse cone of softened pliable composition. As pressure is applied to rod 45 the pressure imposed on the centrally located pool of molten material foces the softened surrounding material into contact with the walls of rigid tube 86. This condition applies even where rod 45 is substantially undersized or substantially out of round. The more pressure that is applied, the more the softened material is forced against the walls of tube 86, thus providing a very effective seal.

The particular advantage of the disclosed apparatus is that it may be very easily and quickly disassembled, if necessary. The feed mechanism assembly 24 can be removed as easily as the top from a conventional household pressure cooker thus opening up the entire inside of the hot melt applicator where the rod of thermoplastic composition is converted to molten form. In addition in the preferred sliding rocker element embodiment of the advancing mechanism while a partially inserted rod cannot be pulled out from the rear, such a rod can easily be removed merely by twisting it. When the rod is manually twisted the elements are displaced slightly sideways and tilted and act like a thread-forming die.

It will be appreciated that the several components of the hot melt applicator of the present invention can be used separately and independently. The melt head very effectively melts thermoplastic rod no matter how that rod is fed into the melt head. The rod advancing mechanism will feed stock of any kind in which case the serrations may be replaced by other types of friction-imparting surfaces if more suitable. Likewise the assembled elements of the hot melt applicator of the present invention can be of any desired size and mounted in any suitable manner.

We claim:

1. A hot melt applicator comprising in combination:

a melt head for progressively melting a pre-formed cylindrical rod of thermoplastic composition pressed against said melt head, said melt head comprising:

a conical element with its apex directed towards the axis of said rod, a tubular element surrounding said conical element and said rod, heating means to heat said conical element to a temperature in excess of that at which said thermoplastic composition becomes molten, a exit port arranged substantially axially of said conical element adjacent the base thereof to permit the removal of molten composition, and at least one passage from the face of said conical element to said exit port, a nozzle element to receive said molten composition from said exit port, rod-feeding means for receiving said pre-formed rod and advancing said rod against said melt head, and means for actuating said rod-feeding means.

2. A hot melt applicator adapted to receive preformed cylindrical rods of thermoplastic composition, to progressively melt said rods and to deliver the molten composition through a nozzle element, comprising in combination:

a melt head, a rod advancing mechanism comprising:

a mounting means provided with an aperture to receive said rod, a plurality of separate ramp elements arranged uniformly on said mounting means in spaced relationship surrounding said aperture, each said ramp element having as an exposed face a planar slope deviating at an angle from the axis of said aperture, a wedge-shaped rod-gripping element arranged on each said exposed face in sliding relation thereto, each said wedge-shaped rod-gripping element having a rear face provided with two offset planar surfaces forming a pivot point therebetween and a forward face arranged to be substantially parallel to the axis of said aperture when the planar surface adjacent to the intersection with said forward face is in contact with the planar slope of said ramp element, elastic means for yieldably retaining each said rod-gripping element on the face of each said ramp and in a position to intercept a face of said rod, whereby when the relative motion between said rod advancing mechanism and said rod is in one direction, said rod-gripping elements are forced up the associated said ramp away from the face of said rod with the planar surface remote from said intersection in contact with said ramp to permit free movement of said rod-advancing mechanism relative to said rod, and when the relative motion is in the opposite direction, said rod-gripping elements rock about said pivot to be jammed between the associated said ramp and the face of said rod preventing any relative motion between said rod and said rod-advancing mechanism, and means for reciprocally moving said rod-advancing mechanism relative to said melt head to advance said rod towards said melt head.

3. A hot melt applicator as claimed in claim 2 wherein said elastic means comprises a spring element that passes through an aperture provided in each said rod-gripping element and is mounted on support means arranged between each said ramp element.

4. A hot melt applicator as claimed in claim 3 wherein the forward face of each said rod-gripping element is provided with a plurality of serrations, the serration closest to the intersection with the rear face acting as a trip point.

5. A hot melt applicator as claimed in claim 4 wherein in each said wedge-shaped rod-gripping element the pivot point, the trip point and the center of the aperture are in line.

6. A melt head for progressively melting a preformed cylindrical rod of thermoplastic composition pressed against said melt head, comprising in combination:

a conical element with its apex directed towards the axis of said rod, a tubular element surrounding said conical element and said rod, heating means to heat said conical element to a temperature in excess of that at which said thermoplastic composition becomes molten, an exit port arranged substantially axially of said conical element adjacent the base thereof to permit the removal of molten composition, and at least one passage from the face of said conical element to said exit port.

7. A stock-advancing mechanism comprising in combination:

a mounting means provided with an aperture to receive said stock, a plurality of separte ramp elements arranged on said mounting means in spaced relationship surrounding said aperture, each said ramp element having as an exposed face a planar slope deviating at an angle from the axis of said aperture, a wedge-shaped stock-gripping element arranged on each said exposed face in sliding relation thereto, each said wedge-shaped rod-gripping element having a rear face provided with two offset planar surfaces forming a pivot point therebetween and a forward face arranged to be substantially parallel to the axis of said aperture when the planar surface adjacent to the intersection with said forward face is in contact with the planar slope of said ramp element, elastic means for yieldably retaining each said stock-gripping element on the face of each said ramp and in a position to intercept a face of said stock, whereby when the relative motion between said stock-advancing mechanism and said stock is in one direction, said stock-gripping elements are forced up the associated said ramp away from the face of said stock with the planar surface remote from said intersection in contact with said ramp to permit free movement of said stock-advancing mechanism relative to said stock, and when the relative motion is in the opposite direction, said stock-gripping elements rock about said pivot to be jammed between the associated said ramp and the face of said stock preventing any relative motion between said stock and said stock-advancing mechanism.

8. A melt head for progressively melting a preformed cylindrical rod of thermoplastic composition pressed against said melt head, comprising in combination:

a conical element with its peak directed toward the axis of said rod, a tubular element surrounding said conical element and said rod, heating means to heat said conical element to a temperature in excess of that at which said thermoplastic composition becomes molten, an exit port arranged substantially axially of said conical element adjacent the base thereof to permit the removal of molten composition, and at least one passage from the face of said conical element to said exit port, whereby as the rod is pressed against said conical element the molten composition is confined to a region immediately adjacent said conical element and the exertion of pressure forces the solid but softened portion of said rod surrounding said conical element into contact with said tube thereby forming a seal between said rod and said tube.

9. A melt head as claimed in claim 8, wherein said tubular element is rigid and is formed of a heat-resistant material having low thermal conductivity.

10. A melt head as claimed in claim 8, wherein the passage from the face of said conical element to said exit port comprises a pair of slots arranged at right angles to each other, each slot bisecting said conical element along the axis thereof.

11. A melt head as claimed in claim 10, wherein the width of each said slot is in the order of about 20 percent of the base diameter of said conical element.

* * * * *